US007021513B2

(12) United States Patent
Strååt

(10) Patent No.: US 7,021,513 B2
(45) Date of Patent: Apr. 4, 2006

(54) STAPLE FORMING ARRANGEMENT IN A STAPLER

(75) Inventor: Olle Strååt, Hestra (SE)

(73) Assignee: Isaberg Sweden AB, Hestra (SE)

( * ) Notice: Subject to any disclaimer, the term of this patent is extended or adjusted under 35 U.S.C. 154(b) by 41 days.

(21) Appl. No.: 10/249,247

(22) Filed: Mar. 26, 2003

(65) Prior Publication Data

US 2003/0201298 A1 Oct. 30, 2003

(30) Foreign Application Priority Data

Mar. 27, 2002 (SE) ..... 0200936

(51) Int. Cl.
*B25B 5/16* (2006.01)

(52) U.S. Cl. ..... 227/83; 227/87; 227/88

(58) Field of Classification Search ..... 227/82–88, 227/93, 119–120, 131, 155; 59/71, 73, 74
See application file for complete search history.

(56) References Cited

U.S. PATENT DOCUMENTS 2,959,786 A * 11/1960 Peterssen ..... 227/83
4,583,276 A * 4/1986 Olesen ..... 29/432.1
4,588,121 A * 5/1986 Olesen ..... 227/120
5,147,080 A * 9/1992 Assink et al. ..... 227/88
5,150,826 A * 9/1992 Logtens ..... 227/88
5,273,199 A * 12/1993 Logtens ..... 227/87
5,346,114 A * 9/1994 Udagawa et al. ..... 227/120
5,662,318 A * 9/1997 Harada et al. ..... 227/88
5,993,876 A * 11/1999 Bertocchi ..... 426/388
6,050,471 A * 4/2000 Yagi ..... 227/120

* cited by examiner

*Primary Examiner*—Scott A. Smith
(74) *Attorney, Agent, or Firm*—Howrey LLP

(57) ABSTRACT

Staple forming arrangement (11) forming part of a stapler (1) in which a workpiece (6), primarily a sheaf of papers, is stapled together. The arrangement includes a bending punch (15), which is driven by a drive mechanism (12,13) and which bends elongated staple blanks (8) over a bending cushion (15). The staple blanks, which are stored in a magazine (7) in the stapler and are fed to the bending cushion by an integral feeding device (14), are bent essentially into a U-shape having a crown (24) and a first leg (25) and a second leg (26), respectively and whereupon the bending punch is withdrawn from the bent staple by the drive mechanism. After the withdrawal of the bending punch from the bent staple, the bent staple is fed by the feeding device to a staple guide channel (27) in which the staple is driven by a drive blade (17) incorporated in the stapler into the multi-piece workpiece in order to staple the pieces together. The arrangement (11) is provided with a first and second leg catcher device 18 and 19, respectively which catch and block the respective staple legs (25 and 26), preventing them from springing back after bending until the staple has been fed into the staple guide channel.

8 Claims, 12 Drawing Sheets

STAPLE FORMING ARRANGEMENT IN A STAPLER

BACKGROUND OF INVENTION

1. Technical Field

The present invention relates to a staple forming arrangement that constitutes a part of a stapler, in which a workpiece, primarily a sheaf of papers, is stapled together. The arrangement includes a bending punch, which is driven by a drive mechanism and which bends elongated staple blanks over a bending cushion. The staple blanks, which are stored in a magazine in the stapler, are fed to the bending cushion by an integral feeding device and are bent essentially into a U-shape having a crown and a first and second leg respectively, whereupon the bending punch is withdrawn from the bent staple. After the removal of the bending punch, the bent staple is fed by the feeding device to a staple guide channel in which the staple is driven into the workpiece by a drive blade incorporated in the stapler in order to staple the workpiece together.

2. Background Art

Staple forming arrangements of the type described above are commonly used and essential components of modern staplers as used, among other applications, in copying machine installations. An arrangement of this type is described in the applicant's own U.S. Pat. No. 5,794,833, which application does not, in itself, relate directly to the staple forming arrangement.

A disadvantage of previously known arrangements is, however, that the legs of the formed, U-shaped staple blank may, before it is fed to the staple guide channel by the feeding device, spring back to the extent that the staple, when fed forward, either does not enter the guide, or enters the guide misaligned. This results in either faulty stapling or, in the worst case, failure to complete stapling due to jamming of the stapler.

SUMMARY OF INVENTION

Based on deficiencies in know staplers, there is a need to provide a staple forming arrangement that ensures that a staple formed by the arrangement does not spring back in such a manner that the staple cannot reliably be fed into the staple guide channel. In answer thereto, the present invention provides a staple forming arrangement that overcomes the disadvantages inherent in existing arrangements of the type described above by incorporating a first and second leg catcher device that catches and blocks the respective staple legs to prevent them from springing back after bending, and until the staple has been fed into the staple guide channel.

The present invention is further characterized in that each of the leg catcher devices is provided with a contact face that enters into blocking contact with the respective staple leg when the staple has been bent. The device is further arranged so that it adjoins the staple guide channel and is designed to yield sufficiently to permit the respective staple legs to move the devices and contact faces thereaside when the staple is being bent. The device then returns to the position in which the respective contact faces are in blocking contact with the respective staple legs after the staple has been bent.

BRIEF DESCRIPTION OF DRAWINGS

The invention will hereinafter be described with reference to the appended drawings, of which.

DETAILED DESCRIPTION

Figure 1:
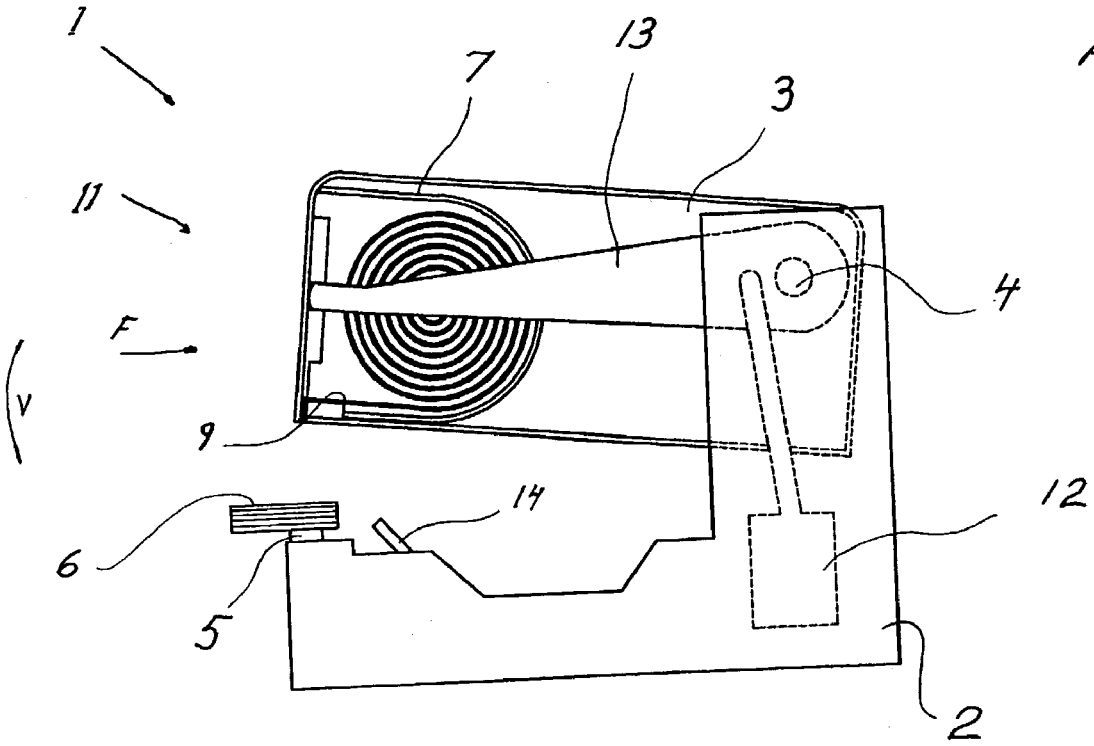
FIG. 1 is a schematic, side elevational view of a stapler that includes a staple forming arrangement configured in accordance with the teachings of the present invention.

FIG. 1 is a side elevational, schematic view of a stapler 1 comprising (including or having) a base part 2 and a stapling unit 3. The stapling unit and base part are connected in a pivotal manner by a pivot pin 4, and the stapling unit can be pivoted toward and away from the base part in the direction indicated by the double arrow v. The base part is provided with an anvil surface 5, on which a workpiece 6 is placed for stapling with the stapler. The stapling unit incorporates a staple magazine 7 containing elongated staple blanks 8 arranged side by side so as to form a staple belt 9, which is illustrated in the form of a reel 10, see FIG. 2. The stapling unit is further provided with a staple forming arrangement 11, whose construction and operation will be clear from the description below. The base part 2 is provided with a drive source 12, which is connected to drive arms 13, only one of which is shown in the figure. The arms are connected to the staple forming arrangement 11 and their function will be clear from the following description. The base part is provided with a feeding device 14, which device, when the stapling unit is driven against the base part in the direction of the double-headed arrow v in the course of an operating cycle, acts on the staple belt 9 so as to feed the staple blanks forward.

Figure 2:
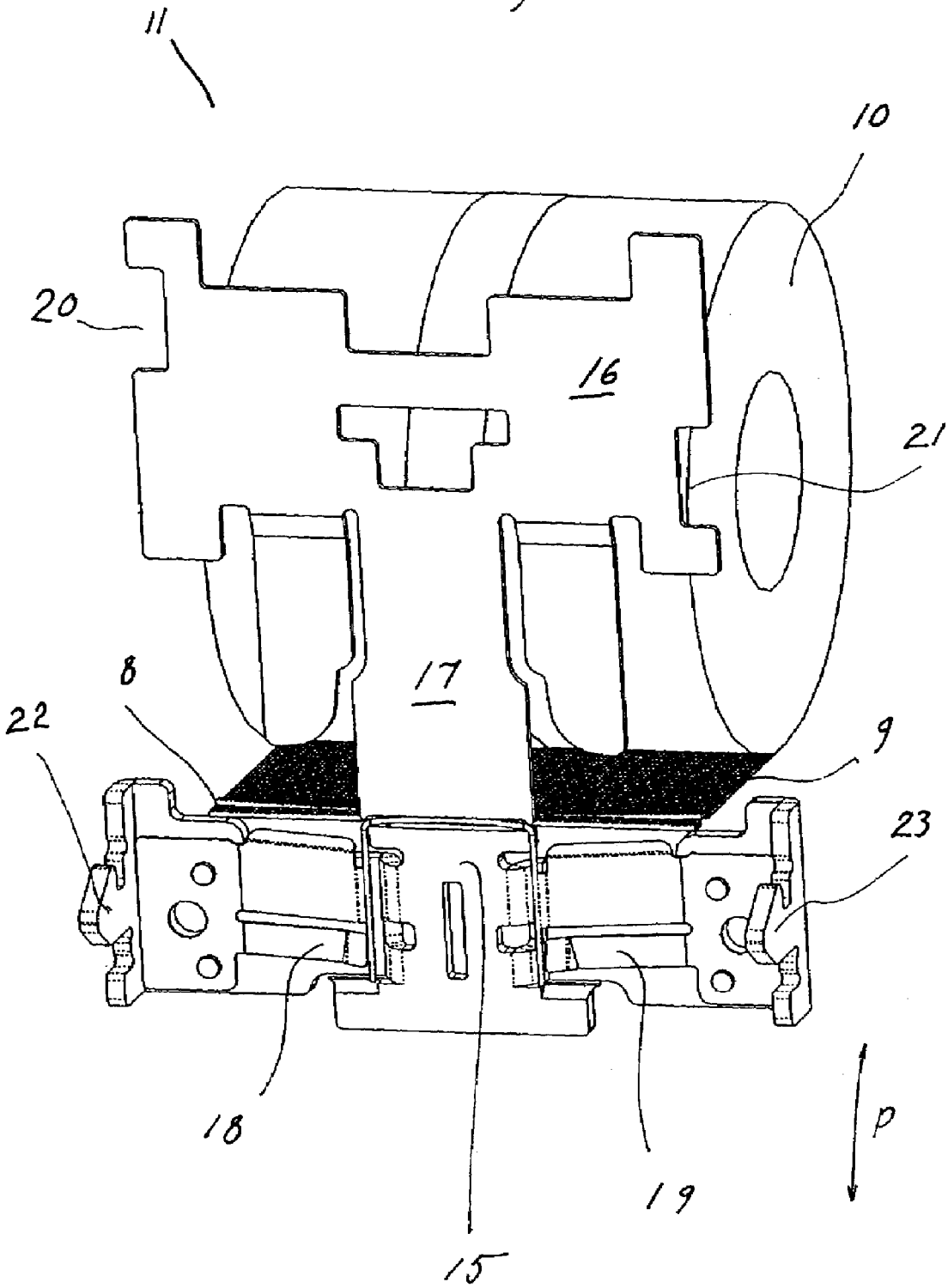
FIG. 2 is a perspective view showing a staple blank magazine and a staple forming arrangement.

FIG. 2 shows the staple reel 10, the staple belt 9 and a staple blanks 8. The figure also shows the staple forming arrangement 11, which comprises a bending cushion 15 over which the staple blanks are bent. A bending punch 16 is shown that has an integrated drive blade 17. A first leg catcher device 18 and a second leg catcher device 19 are provided that ensure that the formed staple legs do not spring back after bending. The figure further shows apertures 20 and 21, respectively in the forming punch, and to which the drive arms 13 are connected to drive the punch 16 and drive blade 17. Hook lugs 22 and 23 are shown, the function of which is to connect parts of the arrangement 11 to the stapler 1. The connection of the bending punch 16 and drive blade 17 to the stapler is not shown in the figure; however, it will be clear to one skilled in the art that they are connected in a known manner such that they can be reciprocatingly driven by the drive arms 13 in an upward and downward path indicated by the double arrow P. It will be clear to one skilled in the art that the arrangement may be connected either to the stapler 1 itself, or to the staple magazine 7. Similarly, it will be clear to one skilled in the art that the bending punch and drive blade, which are shown integrated in the figures, may be separate units.

FIGS. 3–8 show a sequence in which a staple forming arrangement 11 configured in accordance with the present invention is used to bend a staple blank 8 into a U-shape. The arrangement is viewed from the direction indicated by the arrow F in FIG. 1. A staple bent into a U shape comprising a crown 24, a first leg 25 and a second leg 26 is in a position in front of the bending cushion 15 in a staple guide channel 27. In FIG. 9 it is shown that the channel for the U-shaped staple is driven into the workpiece 6, as shown in FIG. 1, to be stapled by the drive blade 17. Simultaneously, the staple blank 8 is bent into a U-shape over the bending cushion 15.

Figure 3:
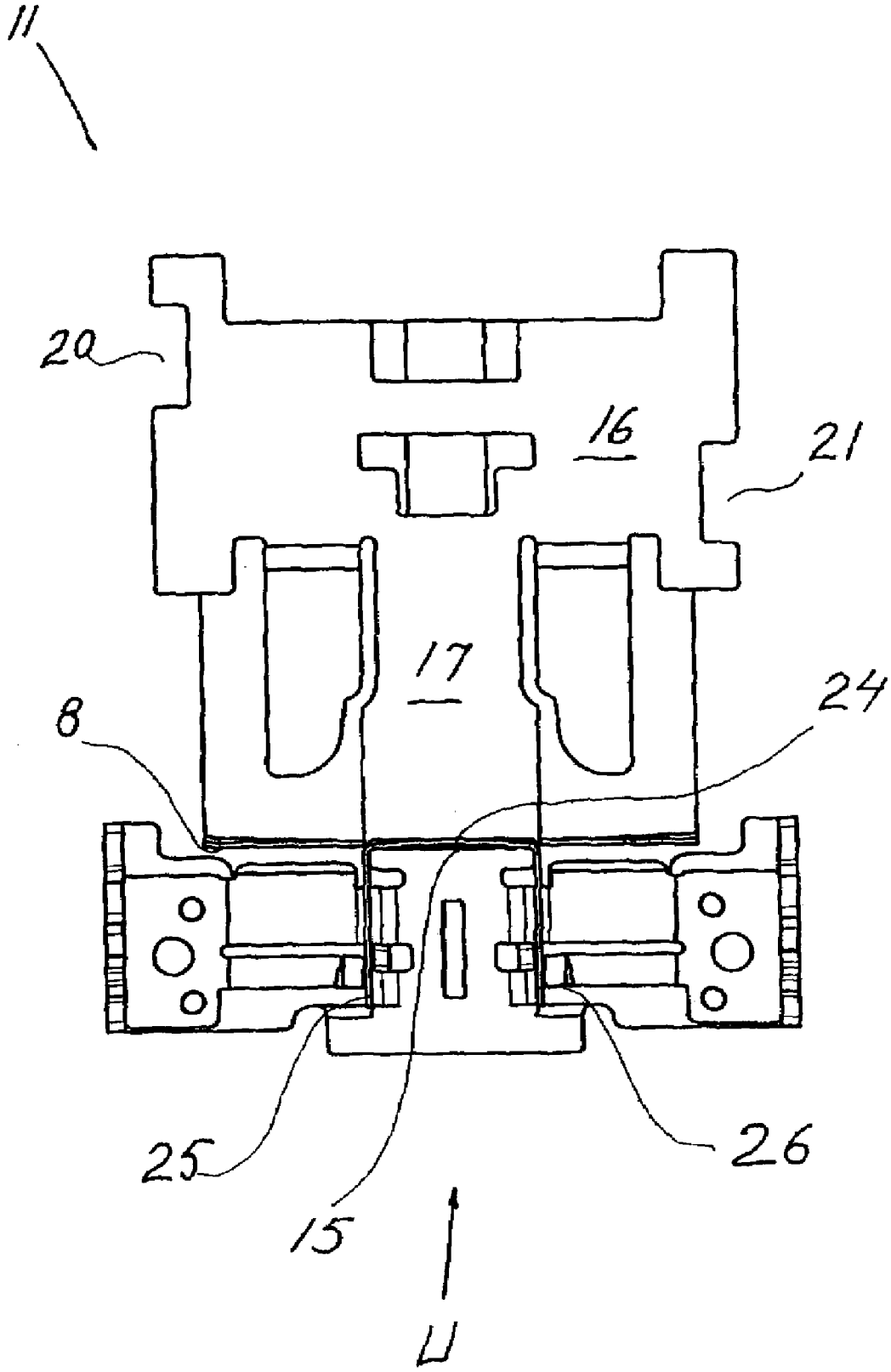
FIGS. 3–8 are detail elevational views showing the arrangement in accordance with the present invention at different stages of an operating cycle in which a straight staple blank is bent into a U-shaped staple form.
Figure 4:
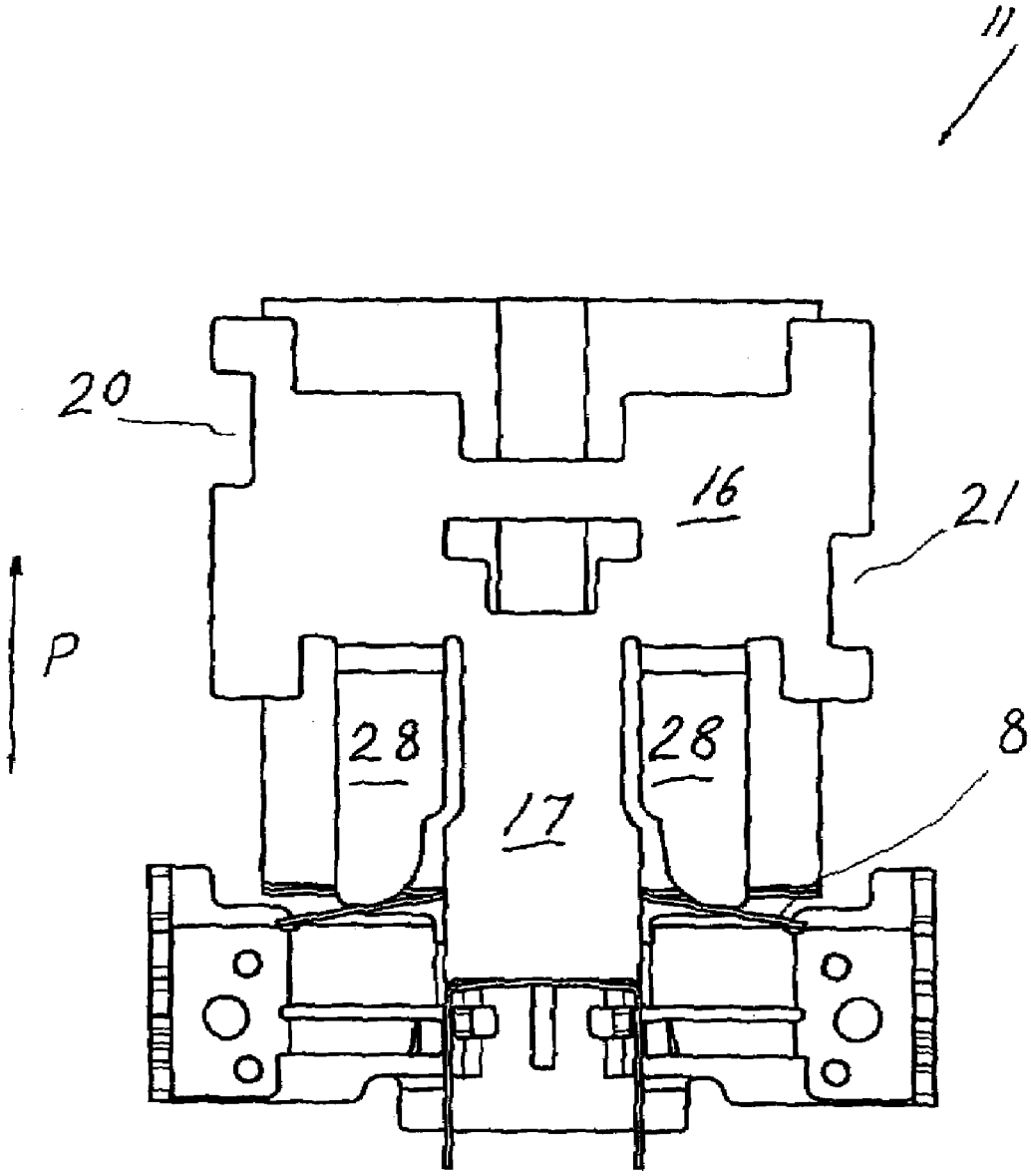
Figure 5:
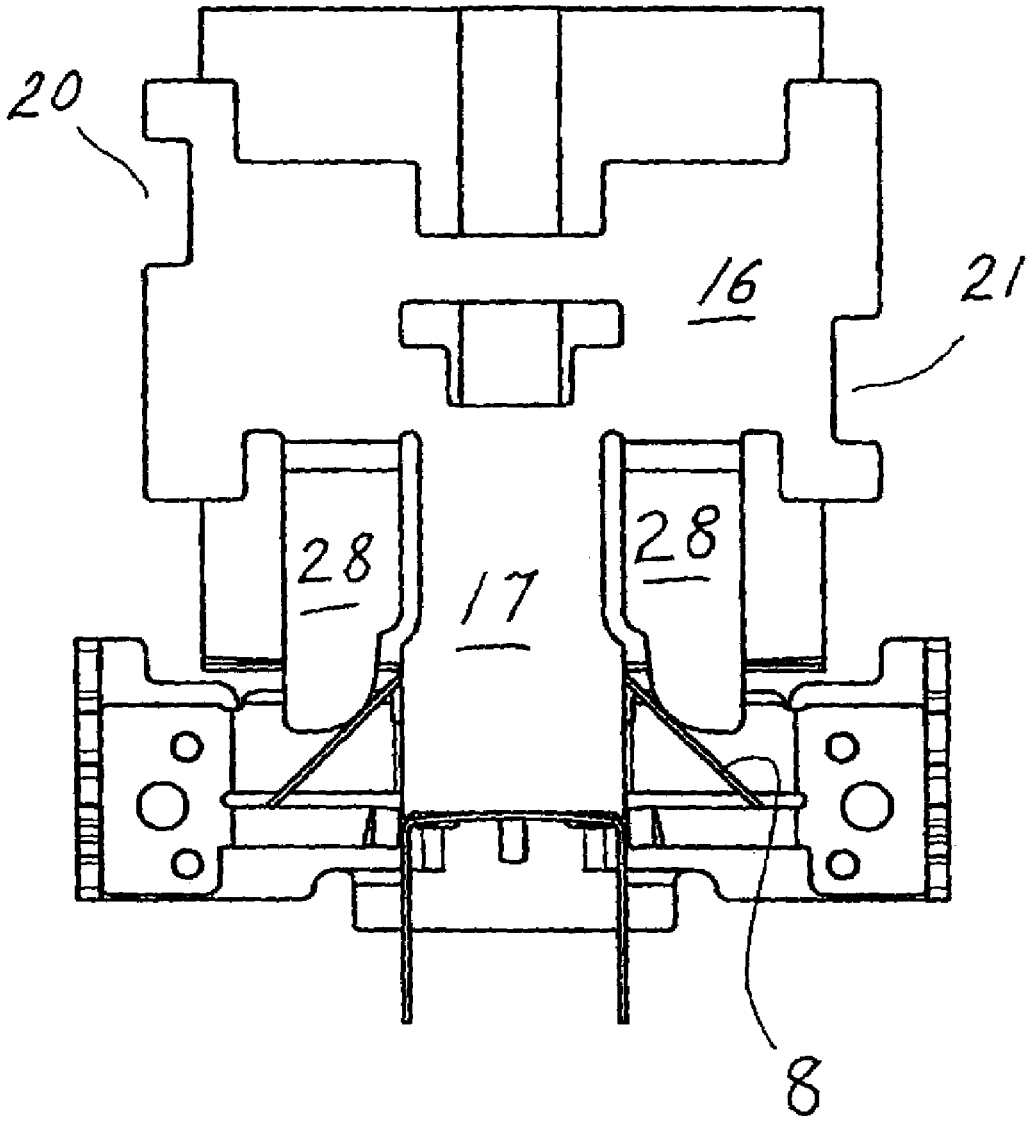
Figure 6:
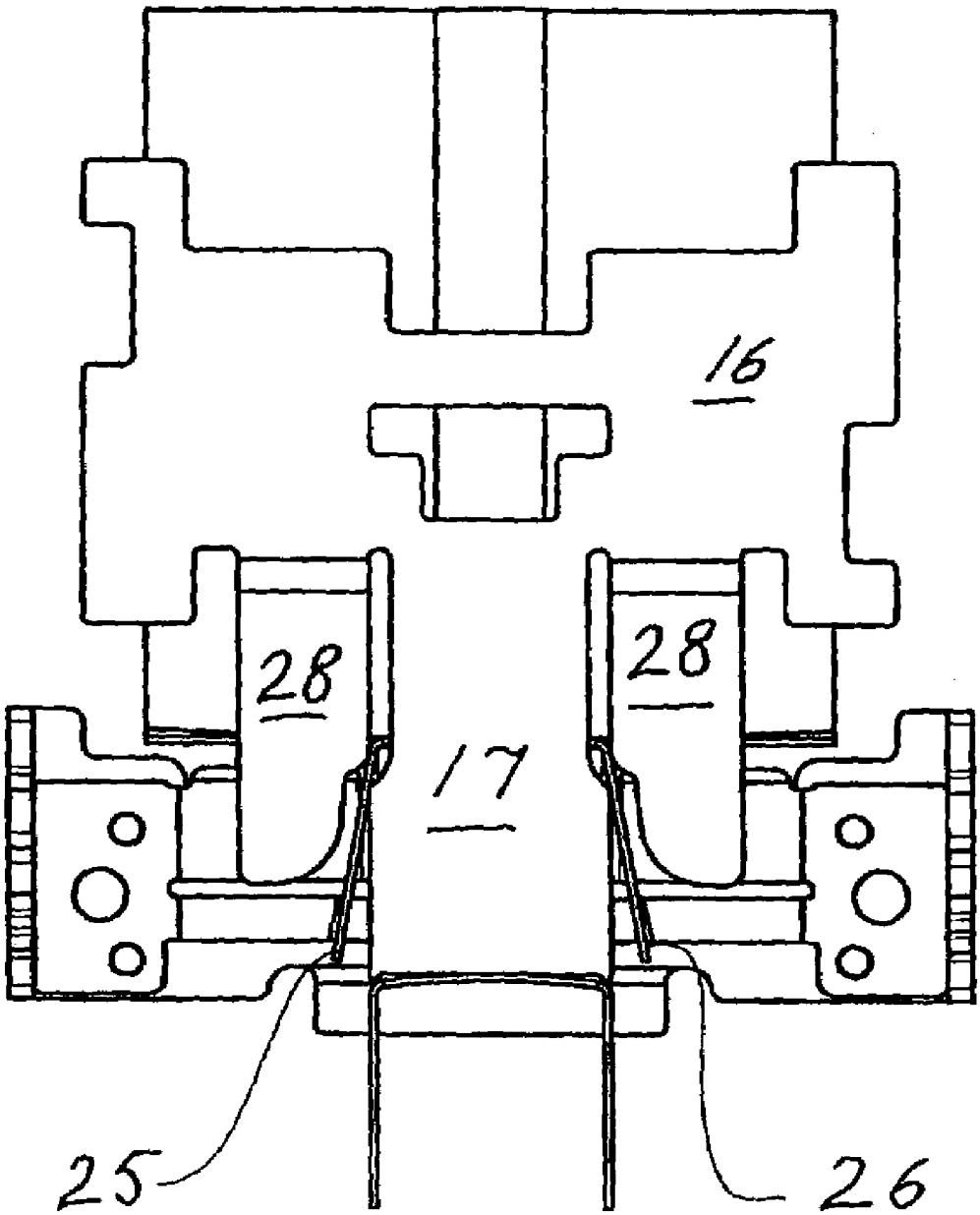
Figure 7:
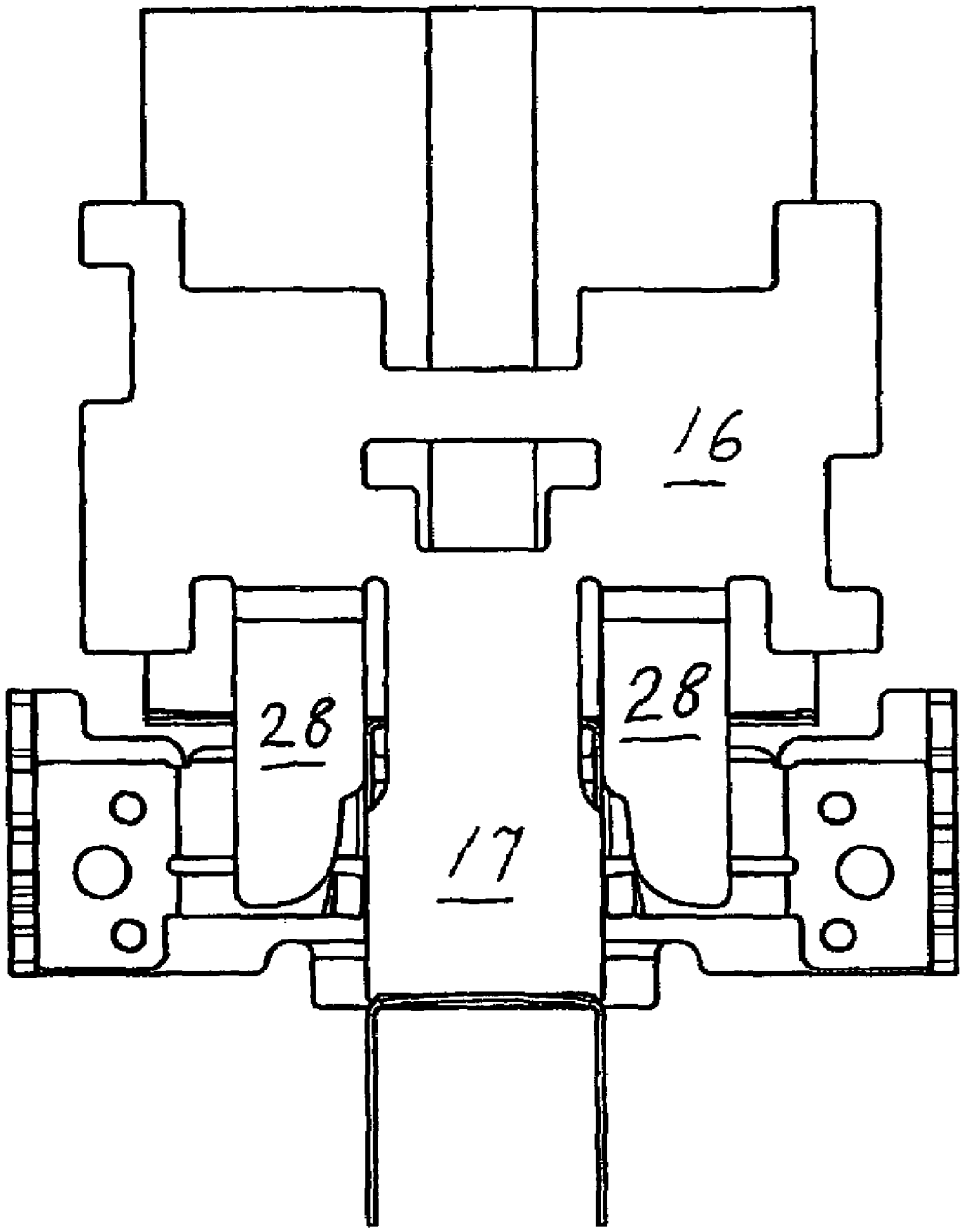

In FIG. 3, a staple blank 8 is shown on the bending cushion 15, and the bending punch 16 and drive blade 17 are in an initial position. In FIG. 4, the bending punch 16 and drive blade 17 have been lowered in the direction of the double arrow P and the bending punch strikes the staple blank 8 with its integral bending arms 28 thereby bending the blank over the bending cushion 15. In FIG. 5, the bending punch 16 has been lowered further and the staple 8 has been bent further. In FIG. 6, the bending punch has been driven further downward, in which position the legs 25 and 26 of the staple are in contact with the leg catcher devices 18 and 19 which, as will be described with reference to FIGS. 9–12. The leg catcher devices 18 and 19 are pushed aside by the staple legs 25 and 26, respectively. In FIG. 7, the bending punch is in a final position in which the staple 8 has been bent into a U-shape, while the drive blade 17 has driven the preceding staple into the workpiece to be stapled.

Figure 8:
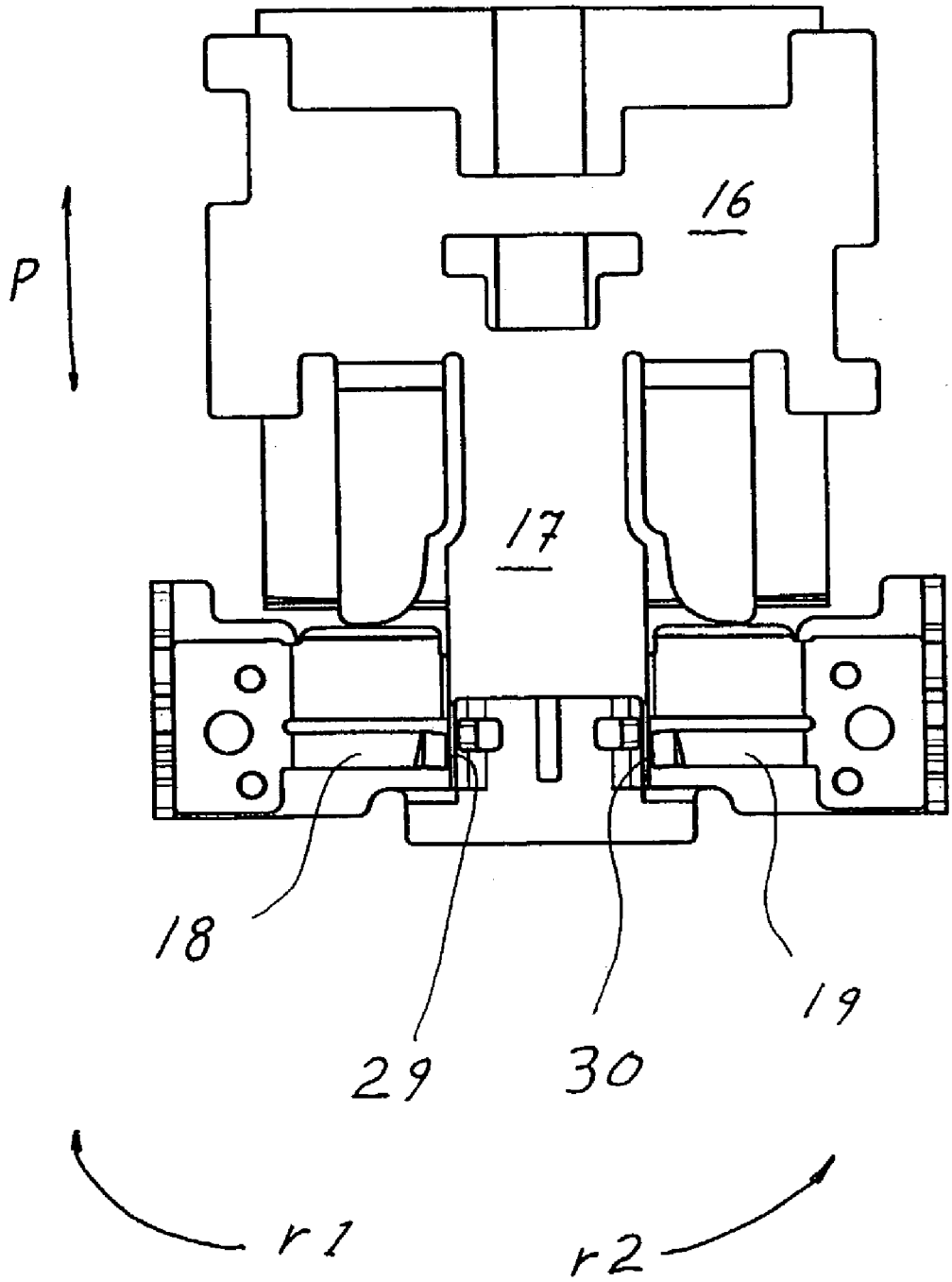
Figure 9:
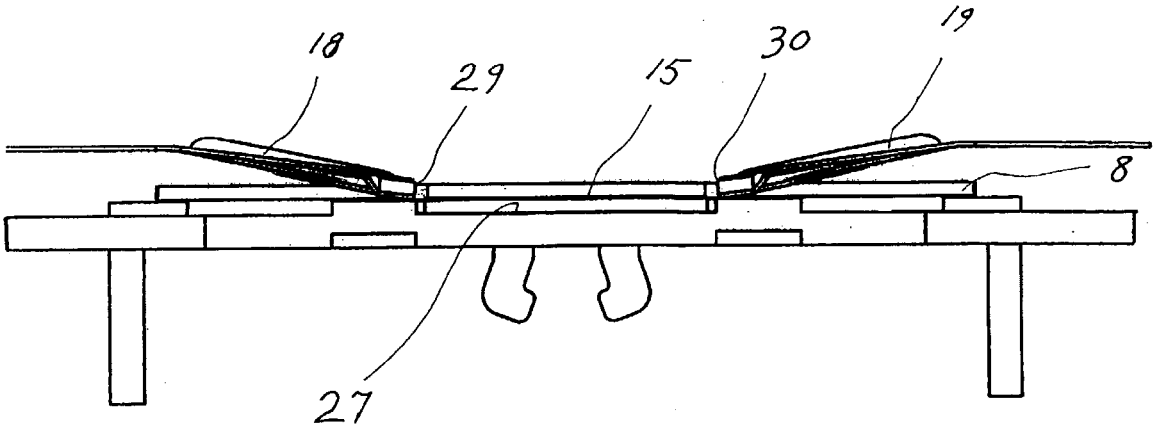
FIGS. 9–12 are detail elevational views which, as viewed from direction P in FIG. 3, show the arrangement in accordance with the present invention at different stages of an operating cycle.

In FIG. 8, the bending punch and drive blade have been raised in the direction of the double arrow P. The figure shows that the leg catcher devices 18 and 19 are provided with contact faces 29 and 30 respectively, which faces are in contact with the staple legs 25, 26 respectively, preventing the legs from springing back in the direction indicated by the arrows r1 and r2. The upward movement continues until the arrangement reaches the initial position shown in FIG. 3, in which position the feeding device 14, which is not shown in the figures, has fed the formed, U-shaped staple to the position shown in FIG. 9 and a new staple blank 8 has been fed to the bending cushion 15.

FIGS. 9–12 show the arrangement 111 in a forming sequence as viewed from below in the direction indicated by the arrow U in FIG. 3; in this view, both the bending punch and drive blade are omitted for clarity. FIG. 9 shows a formed, U-shaped staple in the staple guide channel 27, and also shows the staple catcher devices 18 and 19, whose contact faces 29 and 30 respectively adjoin the staple guide channel 27. The staple leg catcher devices 18 and 19 are lightly pretensioned in the direction of the staple guide channel 27 and are designed to yield sufficiently to permit them to be pushed aside in a direction opposite to the biased direction described immediately above. The figure further shows a staple blank 8 in position on the bending cushion 15.

Figure 10:
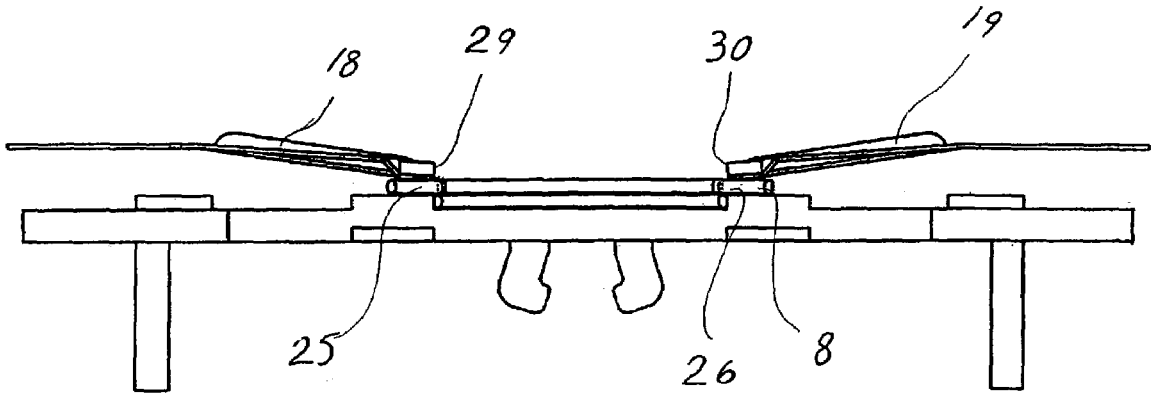
Figure 11:
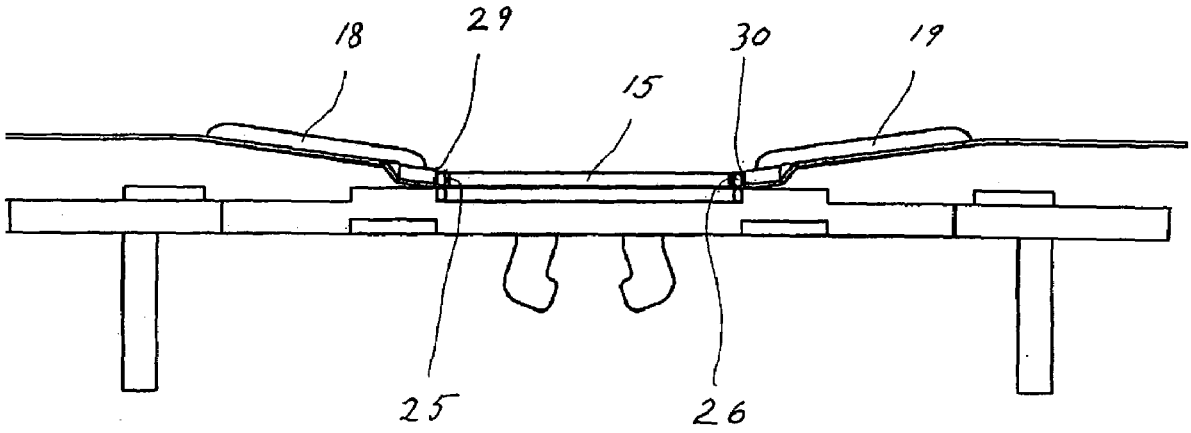
Figure 12:
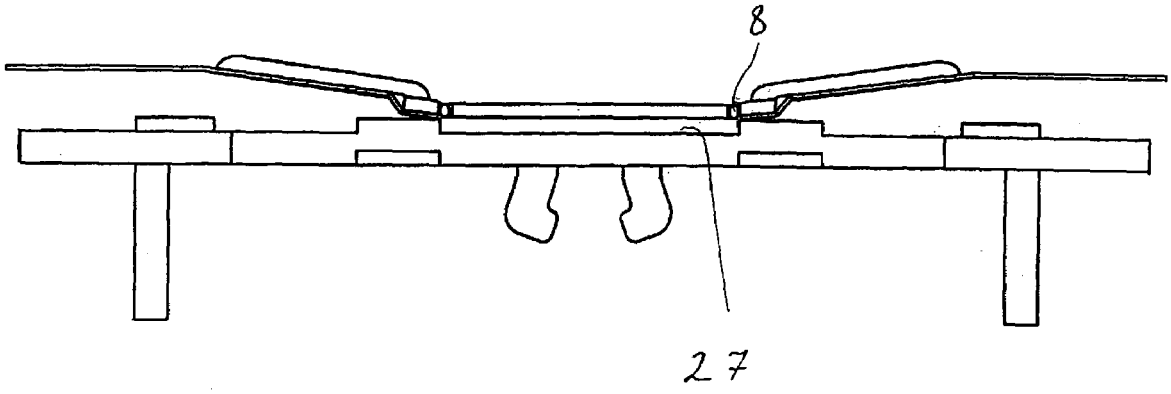

In FIG. 10, the staple blank 8 has been bent further and, as shown, the staple legs 25 and 26 have pushed aside the leg catcher devices 18 and 19, respectively. In FIG. 11, the staple blank has been formed completely and the staple leg catcher devices 18 and 19 have returned to the position in which the contact faces are adjacent to the channel 27. In this position, the contact faces are in contact with the respective staple legs, preventing them from springing back in the direction indicated by the arrows r1 and r2 in FIG. 8. In FIG. 12, the bending sequence has been advanced a stage further and the channel 27 is empty, causing the feeding device 14, which is not shown in the figure, to feed the formed staple forward into the channel 27, while a new staple blank 8 is fed to the bending cushion 15. The forming sequence has now returned to the stage shown in FIG. 9.

It should be appreciated that the invention is not limited by the above exemplary description, but only by the accompanying patent claims.

The invention claimed is:

1. A method for forming U-shaped staples from a staple blank and preventing spring-back of leg portions of the formed staple until the staple is driven into a workpiece, said method comprising:

forming a U-shaped staple from a staple blank by bending the staple blank about a bending cushion using a bending punch, said forming process establishing a crown connecting two legs of the U-shaped staple;

withdrawing the bending punch thereby allowing the legs of the formed staple to tend to spring back toward the original staple blank configuration due to spring characteristics of the staple blank's material of construction; and providing a staple leg catch device that presses against the legs in a shape-maintaining configuration after the bending punch is withdrawn, the catch device arranged to urge the legs toward the bent U-shaped configuration and thereby facilitate continued processing of the staple toward a stapled configuration in a workpiece.

2. The method as recited in claim 1, further comprising:

resiliently biasing the staple leg catch device toward the shape-maintaining configuration thereby permitting the leg catch device to be pushed aside by a progressing bending punch during the forming process and under which the leg catch device assumes the shape-maintaining configuration when the bending punch is withdrawn.

3. The method as recited in claim 2, further comprising:

arranging the staple leg catch device to form a ramp into a staple guide channel where the staple is stapled into a workpiece thereby preventing a jam between a staple that has partially regained its original shape when being advanced into the staple guide channel.

4. A staple formed from a staple blank manufactured in a process that prevents spring-back of leg portions of the formed staple, said manufacturing process comprising:

forming the U-shaped staple from a staple blank by bending the staple blank about a bending cushion using a bending punch, said forming process establishing a crown connecting two legs of the U-shaped staple;

withdrawing the bending punch thereby allowing the legs of the formed staple to tend to spring back toward the original staple blank configuration due to spring characteristics of the staple blank's material of construction; and providing a staple leg catch device that presses against the legs in a shape-maintaining configuration after the bending punch is withdrawn, the catch device arranged to urge the legs toward the bent U-shaped configuration and thereby facilitate continued processing of the staple toward a stapled configuration in a workpiece.

5. The staple being formed by the manufacturing process of claim 4, further comprising:

resiliently biasing the staple leg catch device toward the shape-maintaining configuration thereby permitting the leg catch device to be pushed aside by a progressing bending punch during the forming process and under which the leg catch device assumes the shape-maintaining configuration when the bending punch is withdrawn.

6. The staple being formed by the manufacturing process of claim 5, further comprising:

arranging the staple leg catch device to form a ramp into a staple guide channel where the staple is stapled into a workpiece thereby preventing a jam between a staple that has partially regained its original shape when being advanced into the staple guide channel.

7. A staple forming arrangement in a stapler for stapling a workpiece, primarily a sheaf of papers; the staple forming arrangement comprising:

elongated staple blanks;

a bending cushion over which the staple blanks are bent;

a bending punch which bends the staple blanks over the bending cushion to form bent staples;

a magazine in the stapler containing staple blanks;

an integral feeding device feeding blank staples to the bending cushion and feeding bent staples to a staple guide channel;

a drive blade for driving a staple into the workpiece;

a drive mechanism driving the bending punch such that the blank staples are bent into bent staples having substantially a U-shape, a crown, a first leg and a second leg, and the drive mechanism driving the drive blade such that the bent staples are driven from the staple guide channel into the workpiece; and a first and second leg catcher device, that catches and blocks the first leg and second leg, each leg catcher device prevents the first leg and second leg, respectively, from springing back after bending until the staple has been fed into the staple guide channel.

8. The staple forming arrangement as recited in claim 7, wherein each leg catcher device includes contact faces, which enter into blocking contact with the first leg and second leg, respectively, when the staple is bent, and are so arranged as to adjoin the staple guide channel, each leg catcher device yields sufficiently to permit the first leg and second leg, respectively, to push the leg catcher device and the contact faces aside when the staple is being bent, each leg catcher device returns to the position in which the contact faces are in blocking contact with the first leg and second leg, respectively, after the staple has been bent.

* * * * *